US012677890B2

(12) United States Patent
Andrews et al.

(10) Patent No.: US 12,677,890 B2
(45) Date of Patent: Jul. 14, 2026

(54) APPARATUS AND METHOD OF MANUFACTURING MULTI-PIECE OPEN-BACK ISOLATION GARMENTS

(71) Applicant: Curt G. Joa, Inc., Sheboygan Falls, WI (US)

(72) Inventors: Robert E. Andrews, Falmouth, MA (US); Samuel E. Darcy, Cleveland, WI (US); Scott A. Roehrborn, Sheboygan, WI (US); Jeffrey W. Fritz, Plymouth, WI (US)

(73) Assignee: Curt G. Joa, Inc., Sheboygan Falls, WI (US)

( * ) Notice: Subject to any disclaimer, the term of this patent is extended or adjusted under 35 U.S.C. 154(b) by 126 days.

(21) Appl. No.: 18/564,513

(22) PCT Filed: May 20, 2022

(86) PCT No.: PCT/US2022/030362

§ 371 (c)(1),
(2) Date: Nov. 27, 2023

(87) PCT Pub. No.: WO2022/251075

PCT Pub. Date: Dec. 1, 2022

(65) Prior Publication Data

US 2024/0251890 A1 Aug. 1, 2024

Related U.S. Application Data

(60) Provisional application No. 63/202,096, filed on May 27, 2021.

(51) Int. Cl.
*A41D 13/12* (2006.01)

(52) U.S. Cl.
CPC ..... *A41D 13/1245* (2013.01); *A41D 13/129* (2013.01); *A41D 2300/328* (2013.01); *A41D 2400/44* (2013.01)

(58) Field of Classification Search
CPC ..... A41D 13/1245; A41D 13/129; A41D 13/1209; A41D 13/12; A41D 13/1263;
(Continued)

(56) References Cited

U.S. PATENT DOCUMENTS

D95,456 S 4/1935 Rosen
3,639,915 A * 2/1972 Hrubecky ..... A41H 42/00 2/114

(Continued)

FOREIGN PATENT DOCUMENTS

CN 203762331 U 8/2014
CN 206365518 U 8/2017

(Continued)

OTHER PUBLICATIONS

International Search Report and Written Opinion issued in corresponding PCT Application No. US2022/030362, issued Sep. 20, 2022.

(Continued)

*Primary Examiner* — Uyen T Nguyen
(74) *Attorney, Agent, or Firm* — Quarles & Brady LLP

(57) ABSTRACT

An apparatus for executing a method of manufacturing multi-piece open-back isolation garments (10) includes machinery for creating discrete torso web pieces (12) from a continuous torso web (14), combining the discrete torso pieces with a continuous shoulder web having neck openings (37) therein, and cutting the combined torso and shoulder web structure to form the isolation garments. The isolation garments may be used as protection from potentially hazardous or unclean materials in a variety of different environments.

21 Claims, 9 Drawing Sheets

(58) Field of Classification Search
CPC ..... A41D 13/1272; A41D 13/1236; A41D 13/1254; A41D 2300/328; A41D 2400/44; A41D 1/00; A41H 42/00; A41H 43/00; A41H 43/04; A41B 1/00
See application file for complete search history.

(56) References Cited

U.S. PATENT DOCUMENTS

| | | | | |
|---|---|---|---|---|
| 3,699,591 | A | 10/1972 | Breitkopf et al. | |
| 3,719,955 | A | 3/1973 | Hrubecky | |
| 3,720,957 | A * | 3/1973 | Patience | A41D 13/1236 2/114 |
| D236,293 | S | 8/1975 | Banks | |
| 3,911,499 | A | 10/1975 | Benevento et al. | |
| 4,052,752 | A | 10/1977 | Green | |
| 4,382,303 | A | 5/1983 | Lunt | |
| 4,535,481 | A | 8/1985 | Larson et al. | |
| 4,608,719 | A | 9/1986 | Lunt | |
| 4,646,365 | A * | 3/1987 | Suprise | A41B 13/103 2/51 |
| 4,829,602 | A | 5/1989 | Harreld et al. | |
| 4,837,860 | A * | 6/1989 | Roberts | A41D 27/28 2/51 |
| 5,025,501 | A | 6/1991 | Dillon | |
| 5,367,710 | A | 11/1994 | Karmin | |
| 6,378,136 | B2 | 4/2002 | Matsushita | |
| 6,830,543 | B2 | 12/2004 | Alberts et al. | |
| D533,982 | S | 12/2006 | Graneto | |
| 7,203,974 | B2 | 4/2007 | Jones et al. | |
| D598,638 | S | 8/2009 | Graneto | |
| D622,934 | S | 9/2010 | Graneto | |
| 7,971,274 | B2 | 7/2011 | Graneto | |
| D736,493 | S | 8/2015 | Pasko | |
| D741,044 | S | 10/2015 | Pasko | |
| 9,357,806 | B2 | 6/2016 | Terrell | |
| D774,729 | S | 12/2016 | Pasko | |
| D779,155 | S | 2/2017 | Pasko et al. | |
| D779,156 | S | 2/2017 | Pasko | |
| D785,284 | S | 5/2017 | Pasko | |
| D787,780 | S | 5/2017 | Pasko et al. | |
| D791,434 | S | 7/2017 | Pasko | |
| D792,056 | S | 7/2017 | Reese et al. | |
| 10,117,470 | B2 | 11/2018 | Reese et al. | |
| D836,297 | S | 12/2018 | Pasko | |
| 10,299,521 | B2 | 5/2019 | Wolf et al. | |
| D863,727 | S | 10/2019 | Pasko | |
| 10,441,011 | B2 | 10/2019 | Pasko et al. | |
| 10,470,504 | B2 | 11/2019 | Pasko et al. | |
| 10,470,506 | B2 | 11/2019 | Pasko | |
| 10,835,423 | B2 | 11/2020 | Long et al. | |
| 10,986,882 | B2 | 4/2021 | Johnson | |
| 2001/0032346 | A1 | 10/2001 | Matsushita et al. | |
| 2008/0155728 | A1* | 7/2008 | Hafer | A41D 27/245 2/69 |
| 2013/0091615 | A1 | 4/2013 | Pasko et al. | |
| 2013/0191960 | A1* | 8/2013 | Pasko | A41D 13/129 2/114 |
| 2013/0276204 | A1 | 10/2013 | Pasko et al. | |
| 2013/0318682 | A1* | 12/2013 | Graneto, III | A41D 13/1236 2/114 |
| 2016/0066631 | A1 | 3/2016 | Pasko | |
| 2018/0192713 | A1 | 7/2018 | Genender et al. | |
| 2018/0213858 | A1 | 8/2018 | Malczyk | |
| 2018/0296862 | A1 | 10/2018 | Johnson | |
| 2018/0311514 | A1 | 11/2018 | Johnson | |
| 2018/0343940 | A1 | 12/2018 | Genender et al. | |
| 2019/0283389 | A1* | 9/2019 | Middlesworth | B65H 39/14 |
| 2021/0008396 | A1 | 1/2021 | Johnson | |
| 2021/0059321 | A1* | 3/2021 | Giorgini | A41D 1/04 |
| 2021/0128366 | A1* | 5/2021 | Schneider | A61F 13/15593 |
| 2021/0169158 | A1 | 6/2021 | Mithani et al. | |
| 2022/0087348 | A1 | 3/2022 | Terry et al. | |
| 2023/0404197 | A1* | 12/2023 | Hagelqvist | A41H 43/04 |
| 2024/0268500 | A1 | 8/2024 | Andrews et al. | |
| 2024/0285005 | A1 | 8/2024 | Andrews et al. | |
| 2024/0285012 | A1 | 8/2024 | Andrews et al. | |

FOREIGN PATENT DOCUMENTS

| | | | |
|---|---|---|---|
| CN | 208286439 | U | 12/2018 |
| CN | 109862797 | A | 6/2019 |
| CN | 209090119 | U | 7/2019 |
| CN | 111513402 | A1 | 8/2020 |
| CN | 109171072 | B1 | 9/2020 |
| DE | 102011016497 | A1 | 10/2012 |
| DE | 202014103297 | U1 | 7/2014 |
| DE | 102015121421 | A1 | 4/2017 |
| EP | 490674 | | 10/1996 |
| EP | 2433601 | B1 | 5/2016 |
| FR | 2171386 | A1 | 9/1973 |
| GB | 1352132 | A | 5/1974 |
| KR | 20110027385 | A | 3/2011 |
| KR | 2018012183 | A | 2/2018 |
| KR | 102023620 | B1 | 9/2019 |
| VN | 10022433 | B1 | 12/2019 |
| WO | 2022251075 | A1 | 12/2022 |
| WO | 2022251256 | A1 | 12/2022 |
| WO | 2022251260 | A1 | 12/2022 |
| WO | 2022260858 | A1 | 12/2022 |

OTHER PUBLICATIONS

McKesson, "Endoscopy Procedure Gown X-Large Blue NonSterile AAMI Level 3 Disposable", (2021) https://mms.mckesson.com/product/841166/Welmed-9100-220XL.

McKesson, "Over-the-Head Protective Procedure Gown TIDIShield® One Size Fits Most Light Blue Non Sterile Disposable", (2021) https://mms.mckesson.com/product/820822/Tidi-Products-8575.

Molnlycke, "Barrier surgical gown Classic Urology", (Jun. 22, 2021) https://www.molnlycke.sg/products-solutions/barrier-surgical-gown-classic-urology/.

Welmed, "Thumb Loop Isolation Gown, Universal, Blue, Thumb Loop Wrists", (2021) https://welmed.us/infection-prevention/protective-apparel/isolation-gowns/thumb-loop-isolation-gown-universal-blue-thumb-loop-wrists/.

* cited by examiner

APPARATUS AND METHOD OF MANUFACTURING MULTI-PIECE OPEN-BACK ISOLATION GARMENTS

CROSS REFERENCE TO RELATED APPLICATION

This application is the U.S. National Stage of PCT/US2022/030362 with international filing date of May 20, 2022, and which claims priority to U.S. Provisional Application No. 63/202,096 filed on May 27, 2021, the contents of which are incorporated by reference in their entireties.

BACKGROUND OF THE INVENTION

Embodiments of the present invention relate to isolation garments and, more particularly, to multi-piece open-back isolation garments.

Isolation garments are useful in protecting the individuals wearing them from hostile environments. For example, hospital staff, patients, and visitors may wear isolation garments to avoid exposure to blood, other body fluids, and infectious materials or to protect patients, especially those with weakened immune systems, from infection. Also, individuals working in industrial facilities may wear isolation garments to prevent contact with hazardous chemicals. However, isolation garments may be worn in other conditions as well, especially in light of requirements imposed by some jurisdictions to prevent exposure to coronavirus disease 2019 (COVID-19). As an example, hair dressers or barbers may be required to wear isolation garments during their appointments.

Manufacturers produce isolation garments using a variety of different methods. In one method, an automated system combines material webs to construct a portion of an isolation garment. However, the product produced by the automated system does not include sleeves and is not folded. Thus, the isolation garments are finished by hand, with sleeves being sown onto the initial product and then folded for packaging. This method results in a slow production speed and involves a high level of manual labor input.

Another method involves producing isolation garments using a sequential or non-continuous operation. That is, cutting the material webs, combining the webs, and folding of the webs are all performed at different stations. Therefore, the isolation garments must be constantly transferred between the stations in their various stages of production. Further, the combining of the webs and the folding and packaging of the resulting isolation garments is performed by hand. As such, this method is also slow and requires much manual labor.

Still another method that involves a high degree of manual input is one in which an individual cuts the shape of isolation garments out of one material web or out of a stack of material webs. The rest of the material web is discarded as scrap. Thereafter, the material webs are bonded, folded, and packaged manually. The end result is a plurality of isolation garments produced by a slow, manual method that produces a large amount of wasted raw material.

It would therefore be desirable to provide an apparatus and method of manufacturing isolation garments that can produce isolation garments quickly and do not depend on a high level of manual input or result in a large amount of raw material scrap.

BRIEF STATEMENT OF THE INVENTION

In accordance with one aspect of the invention, an apparatus for manufacturing multi-piece open-back isolation garments includes a neck cutting unit configured to cut neck openings in a continuous shoulder web and a first bonding unit configured to create underarm seams between first shoulder web panels and second shoulder web panels overlapping each other in the continuous shoulder web. The apparatus also includes a torso cutting unit configured to cut discrete torso web pieces from a continuous torso web and a transfer unit configured to transfer the discrete torso web pieces onto the first shoulder web panels of the continuous shoulder web such that a top edge of each discrete torso web piece overlaps a bottom edge of the first shoulder web panels in an area of the first shoulder web panels that is uncovered by the second shoulder web panels. In addition, the apparatus includes a second bonding unit configured to bond the discrete torso web pieces to the first shoulder web panels in the area uncovered by the second shoulder web panels to create a continuous isolation garment web.

In accordance with another aspect of the invention, a method of manufacturing multi-piece open-back isolation garments includes cutting neck openings in a continuous shoulder web traveling in a machine direction and forming first shoulder web panels and second shoulder web panels overlapping each other in a continuous shoulder web, the first and second shoulder web panels having respective bottom edges offset from each other to create an area on the first shoulder web panel that is uncovered by the second shoulder web panel. The method additionally includes creating underarm seams between the first and second shoulder web panels and cutting a continuous torso web into discrete torso web pieces. Furthermore, the method includes transferring the discrete torso web pieces onto the first shoulder web panels such that a top edge of each discrete torso web piece overlaps the bottom edge of the first shoulder web panels in the area of the first shoulder web panel that is uncovered by the second shoulder web panels and bonding the discrete torso web pieces to the first shoulder web panels in the area that is uncovered by the second shoulder web panels to create a continuous isolation garment web.

In accordance with yet another aspect of the invention, a multi-piece garment includes a shoulder web piece having a first shoulder web panel and second shoulder web panel overlapping the second shoulder web panel. The first shoulder web panel includes a bottom edge and a pair of underarm edges extending out from the bottom edge, and the second shoulder web panel includes a bottom edge offset from the bottom edge of the first shoulder web panel to create an area on first shoulder web panel that is uncovered by the second shoulder web panel and a pair of underarm edges extending out from the bottom edge of the second shoulder web panel and substantially aligned with the pair of underarm edges of the first shoulder web panel. The shoulder web piece further includes a pair of underarm seams joining the first and second shoulder web panels at adjacent underarm edges of the first and second shoulder web panels to form first and second sleeves in the shoulder web piece and a neck opening formed in the first and second shoulder web panels across from the bottom edges of the first and second shoulder web panels. The multi-piece garment also includes a torso web piece comprising a top edge overlapping the bottom edge of the first shoulder web panel of the shoulder web piece in the area uncovered by the second shoulder web panel of the shoulder web piece, the torso web piece attached to the first shoulder web panel via a seam positioned between the top edge of the torso web piece and the bottom edge of the first shoulder web panel.

Various other features and advantages of the present invention will be made apparent from the following detailed description and the drawings.

BRIEF DESCRIPTION OF THE DRAWINGS

The drawings illustrate embodiments presently contemplated for carrying out the invention.

In the drawings.

DETAILED DESCRIPTION

Embodiments of the present invention provide for an apparatus and method of manufacturing multi-piece open-back isolation garments. In executing the method of manufacturing, the apparatus utilizes a series of cutting, folding, bonding, and transfer units. These units operate together to create discrete torso web pieces from a continuous torso web, combine the discrete torso pieces with at least one continuous shoulder web, cut the combined torso and shoulder web structure to form the multi-piece open-back isolation garments, and fold or roll up the multi-piece open-back isolation garments for packaging. The multi-piece open-back isolation garments may be used in a variety of environments such as, for example, as isolation gowns in medical environments, as an alternative to coveralls in industrial environments, and any other environments in which isolation from potentially hazardous or unclean materials or other individuals is desired. Thus, while referred to hereafter as "isolation gowns," it is contemplated that the garments described herein may be manufactured for use outside of the healthcare industry.

Figure 1A:
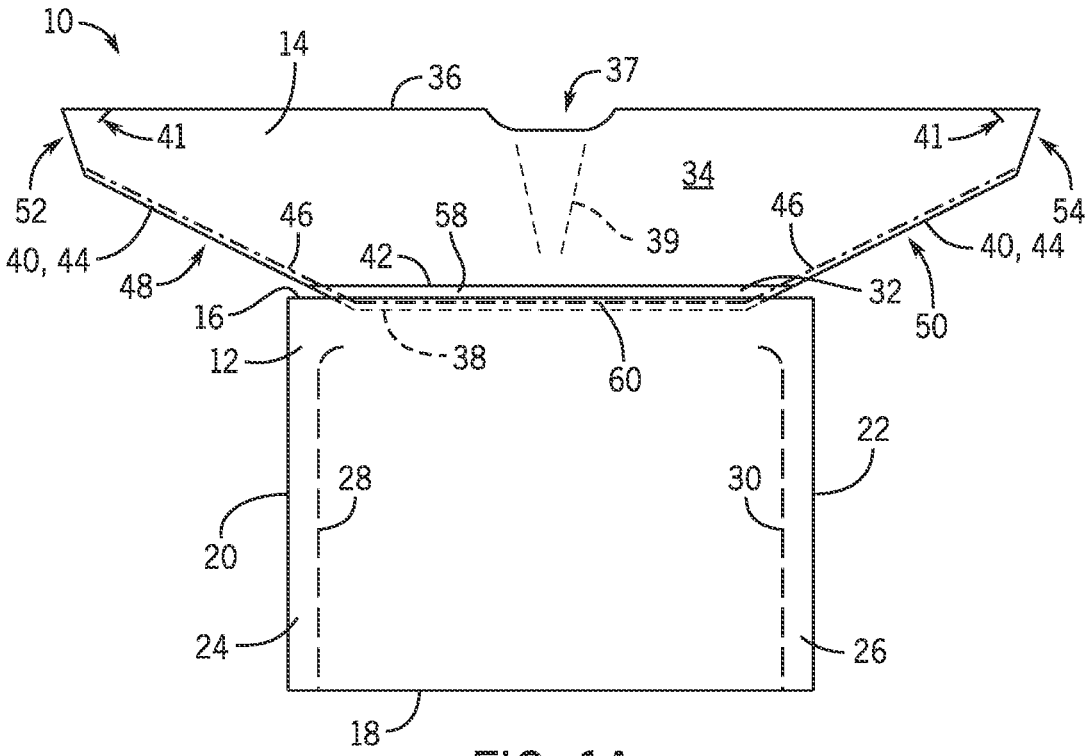
FIG. 1A is a rear view of a multi-piece open-back isolation garment, according to an embodiment of the invention.

Referring to FIG. 1A, a rear view of a multi-piece open-back isolation gown 10 is shown, according to an embodiment of the invention. Isolation gown 10 includes a torso web piece 12 and a shoulder web piece 14. Torso and shoulder web pieces 12, 14 may include nonwoven materials, woven materials, films, foams, and/or composites or laminates of any of these material types. Torso web piece 12 includes a top edge 16, a bottom edge 18, and left side and right side edges 20, 22 extending between top and bottom edges 16, 18. However, in various embodiments, torso web piece 12 may have a different shape resulting in a different number and arrangement of edges. Torso web piece 12 further includes two optional tie straps 24, 26 along left and right side edges 20, 22. Tie straps 24, 26 may be separated from the rest of torso web piece 12 along perforation lines 28, 30 spaced apart from left and right side edges 20, 22, respectively, but remain integrated with torso web piece 12 adjacent top edge 16. Tie straps 24, 26 may then be pulled back by a wearer of isolation gown 10 in order to keep isolation gown 10 close to the wearer and further prevent contact with possibly unsafe substances.

Figure 1B:
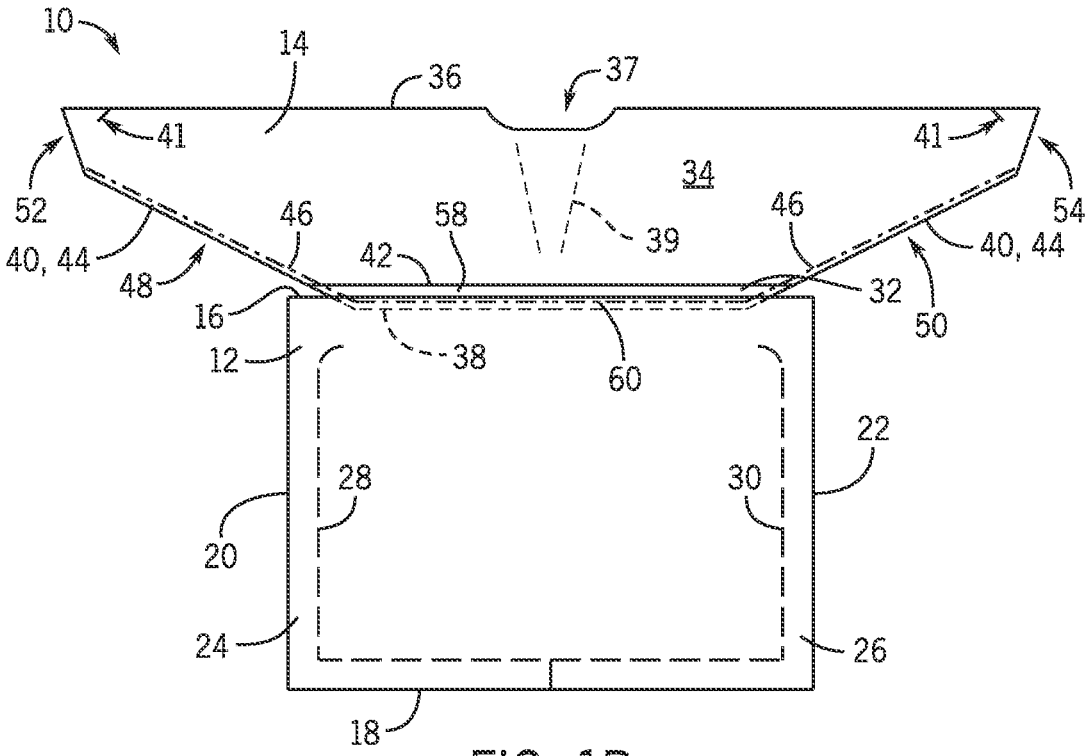
FIGS. 1B, 1C, and 1D are rear views of multi-piece open-back isolation garments, according to alternative embodiments of the invention.
Figure 1C:
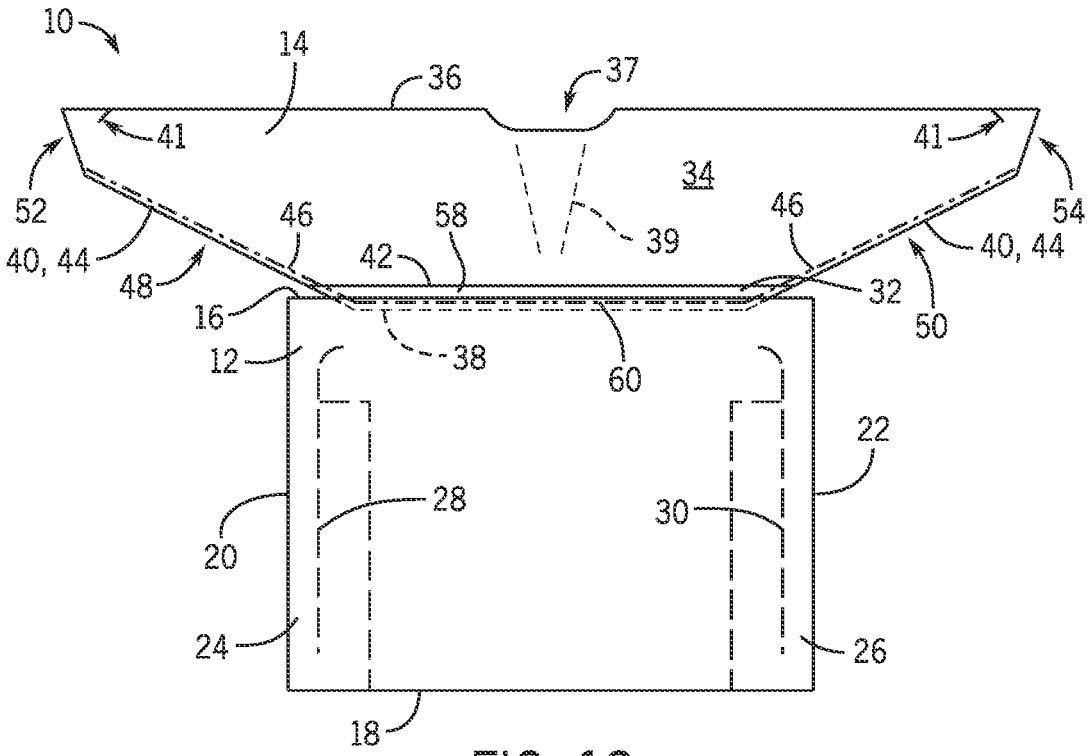
Figure 1D:
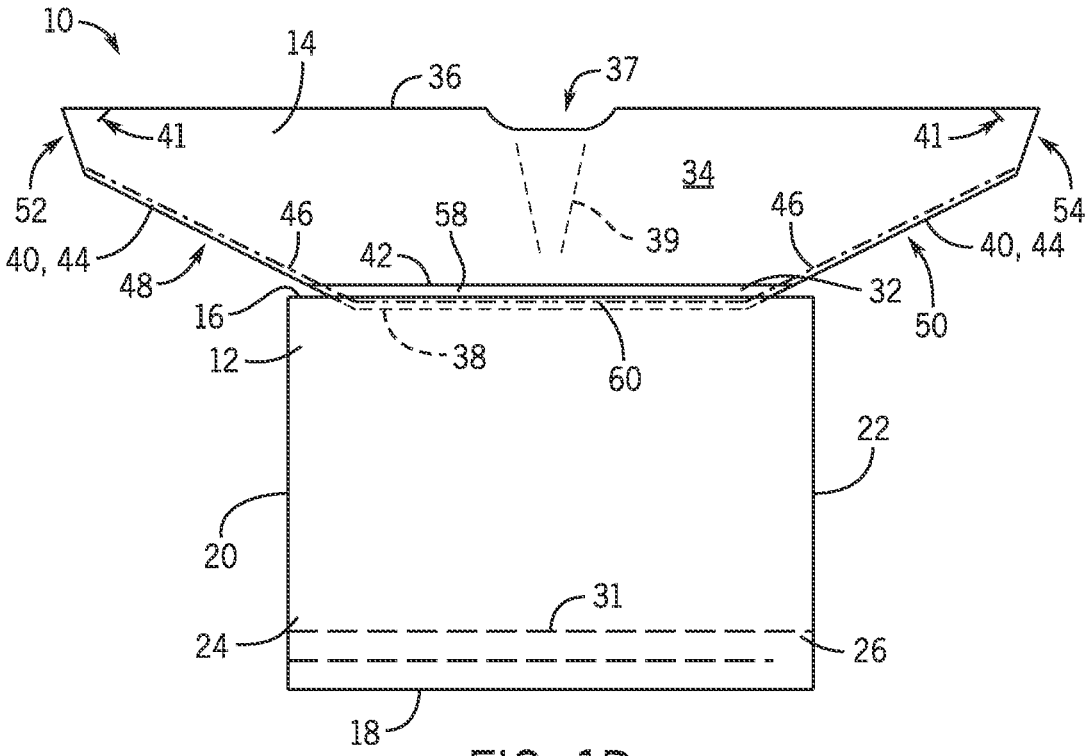

While FIG. 1A shows torso web piece 12 with two tie straps 24, 26 extending down to bottom edge 18 at side edges 20, 22, torso web piece 12 may include different tie strap configurations resulting from different perforation line configurations. As a non-limiting example, perforation lines 28, 30 may stop short of bottom edge 18 and extend away from side edges 20, 22, respectively, before extending down to bottom edge 18 such that tie straps 24, 26 are lengthened along bottom edge 18 as shown in FIG. 1B. As another non-limiting example, perforation lines 28, 30 may be arranged on torso web piece 12 such that tie straps 24, 26 extend down side edges 20, 22 and then wind back up toward top edge 16 in order to lengthen tie straps 24, 26 as shown in FIG. 1C. As yet another non-limiting example, perforation lines 28, 30 may be replaced by at least one perforation line 31 extending along torso web piece 12 near bottom edge 18 in order to perforate a single tie strap along bottom edge 18 as shown in FIG. 1D. In that case, the single tie strap may be completely separable from torso web piece 12 such that wearers of isolation gown 10 can wrap the separated tie strap around their waists and tie it in position. In yet other alternative embodiments, tie straps may be omitted from the integrated structure of the multi-piece open-back isolation gown 10 entirely and separately packaged with gown 10.

Shoulder web piece 14 of isolation gown 10 includes overlapping front and rear shoulder web panels 32, 34. In multi-piece open-back isolation gowns 10 of FIGS. 1A-1D, front and rear shoulder web panels 32, 34 share a folded top edge 36. However, front and rear shoulder web panels 32, 34 may also be formed from two discrete shoulder web panels with separate top edges (not shown) in an alternative embodiment. In that case, shoulder web piece 14 would include a seam (not shown) between shoulder web panels 32, 34 adjacent the two top edges. Regardless, top edge 36 includes a substantially centralized neck opening 37.

Shoulder web piece 14 may also include one or multiple optional neck perforation lines 39 that extend down from neck opening 37 on rear shoulder web panel 34 such that a wearer of isolation gown 10 is able to tear out a portion of rear shoulder web panel 34 to make neck opening 37 larger or to completely tear rear shoulder web panel 34 apart. Tearing apart rear shoulder web panel 34 may aid wearer in removing isolation gown 10 without being contaminated by a substance that landed on isolation gown 10 during a medical procedure or industrial activity, as non-limiting examples. A larger neck opening 37 may make a wearer more comfortable while wearing isolation gown 10. In addition, shoulder web piece 14 may also include optional thumb slits or holes 41, referred to hereafter as thumb openings 41, along top edge 36 in order to allow wearers of isolation gown 10 to insert their thumbs therethrough and have greater control over the movement of isolation gown 10.

Front shoulder web panel 32 includes a front bottom edge 38 and two front underarm edges 40 extending from front bottom edge 38 toward top edge 36, and rear shoulder web panel 34 includes a rear bottom edge 42 and two rear underarm edges 44 extending from rear bottom edge 42 toward top edge 36 at approximately the same angle as front underarm edges 40. Shoulder web piece 12 includes underarm seams 46 joining front and rear shoulder web panels 32, 34 at adjacent front and rear underarm edges 40, 44 in order to create left and right sleeves 48, 50 having respective left and right wrist openings 52, 54 defined between underarm seams 46 and top edge 36. While depicted as being circular in shape, wrist openings 52, 54 may be square, rectangular, triangular or other shapes as dictated by design specifications.

Front and rear underarm edges 40, 44 are substantially aligned with each other. However, front bottom edge 38 is offset from rear bottom edge 42. That is, front bottom edge 38 is farther away from top edge 36 than rear bottom edge 42. The offset between front bottom edge 38 and rear bottom edge 42 creates an area 58 of front shoulder web panel 32 that is uncovered by second shoulder web panel 34 where a seam 60 is formed between torso web piece 12 and front shoulder web panel 32 of shoulder web piece 14 to attach torso and shoulder web pieces 12, 14 together. Underarm seams 46 and seam 60 may be created using a variety of different bonding techniques that attach together two or more material layers such as thermal, ultrasonic, pressure, or adhesive bonding techniques and various other forms of bonding known in the industry.

Figure 2:
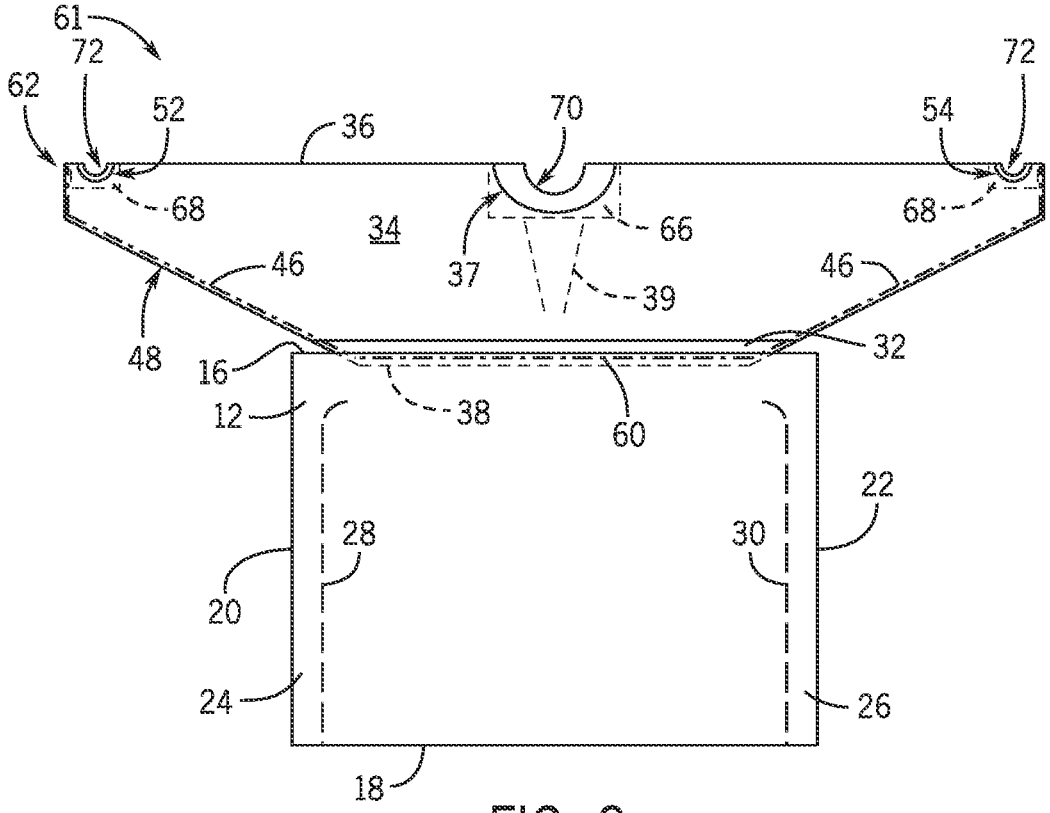
FIGS. 2 and 3 are rear views of multi-piece open-back isolation garments, according to alternative embodiments of the invention.
Figure 3:
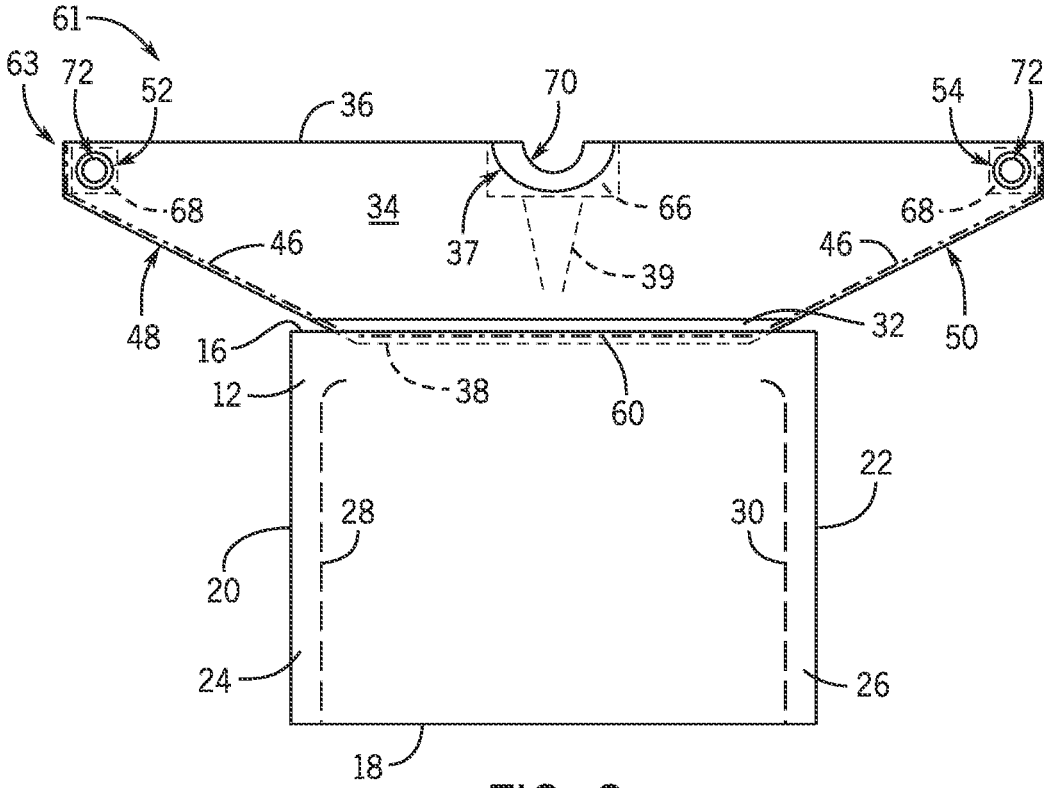

Referring now to FIGS. 2 and 3, isolation gowns 61, 63 are illustrated, according to alternative embodiments of the invention. Isolation gowns 61, 63 differ from isolation gown 10 by incorporating alternative shoulder web pieces 62, 64 in place of shoulder web piece 14 shown in FIGS. 1A-1D. Isolation gowns 61, 63 are illustrated as including torso web piece 12 having the tie strap configuration of FIG. 1A, but it is contemplated that other embodiments may include any of the alternative tie strap configurations illustrated in FIGS. 1B-1D. Since shoulder web pieces 62, 64 are arranged similarly to shoulder web piece 14 of FIGS. 1A-1D, like elements in shoulder web pieces 62, 64 are numbered identically to corresponding elements in shoulder web piece 14. The only differences between shoulder web piece 14 of FIGS. 1A-1D and shoulder web pieces 62, 64 are the arrangement of wrist openings 52, 54 in sleeves 48, 50, the addition of a neck stretch patch 66 over neck opening 37 in front and rear shoulder web panels 32, 34, and the addition of wrist stretch patches 68 over wrist openings 52, 54 in lieu of optional thumb openings 41.

In shoulder web piece 62 of FIG. 2, wrist openings 52, 54 are located along the top edge 36. Neck stretch patch 66 is folded over top edge 36 across neck opening 37, and wrist stretch patches 68 are folded over top edge 36 across wrist openings 52, 54. In shoulder web piece 64 of FIG. 3, wrist openings 52, 54 are located in front shoulder web panel 32 between top edge 36 and underarm seams 46. Neck stretch patch 66 is folded over top edge 36 across neck opening 37, and wrist stretch patches 68 are positioned over wrist openings 52, 54 on front shoulder web panel 32. Thus, the difference between shoulder web piece 62 of FIG. 2 and shoulder web piece 64 of FIG. 3 is the location of wrist openings 52, 54 and wrist stretch patches 68. However, in each of shoulder web pieces 62, 64, neck and wrist stretch patches 66, 68 function in the same way, as described below with respect to FIG. 4.

Figure 4:
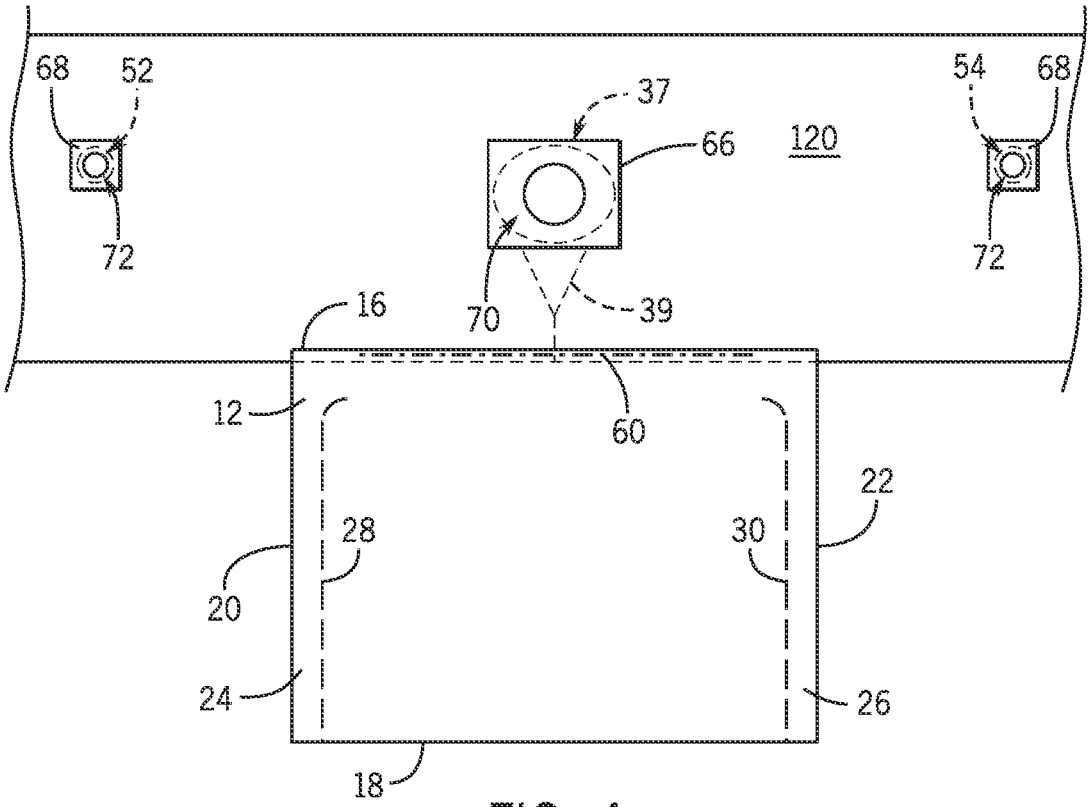
FIG. 4 is a top view of a portion of the production flow for forming the multi-piece open-back isolation garments of FIGS. 2 and 3 illustrating application of stretch patches, according to an embodiment of the invention.

Referring to FIG. 4, a top view of neck stretch patch 66 and wrist stretch patches 68 of shoulder web pieces 62, 64 of FIGS. 2 and 3 are illustrated in relation to a continuous shoulder web 120 including neck opening 37 and wrist openings 52, 54 of shoulder web pieces 62, 64 of FIGS. 2 and 3 during the manufacturing process for isolation gowns 61, 63, according to an embodiment of the invention. Neck stretch patch 66 includes a neck opening 70 therein smaller than neck opening 37 in front and rear shoulder web panels 32, 34 shown in phantom. Similarly, each wrist stretch patch 68 includes a wrist opening 72 therein smaller than wrist openings 52, 54, which are shown in phantom. Neck and wrist stretch patches 66, 68 are made of a stretchable material such as, for example, an elastic film, elastic adhesive, elastic composite, or elastic laminate. Since neck and wrist stretch patches 66, 68 are stretchable, a wearer's neck and hands may still fit through the smaller neck and wrist holes 70, 72, respectfully. Thereafter, neck and wrist stretch patches 66, 68 contract onto the wearer's neck and wrists to create seals that may additionally protect against potentially hazardous, infectious, or unclean materials entering isolation gown 10. As such, the inclusion of neck and wrist stretch patches 66, 68 are beneficial to wearers of isolation gown 10.

Figure 5:
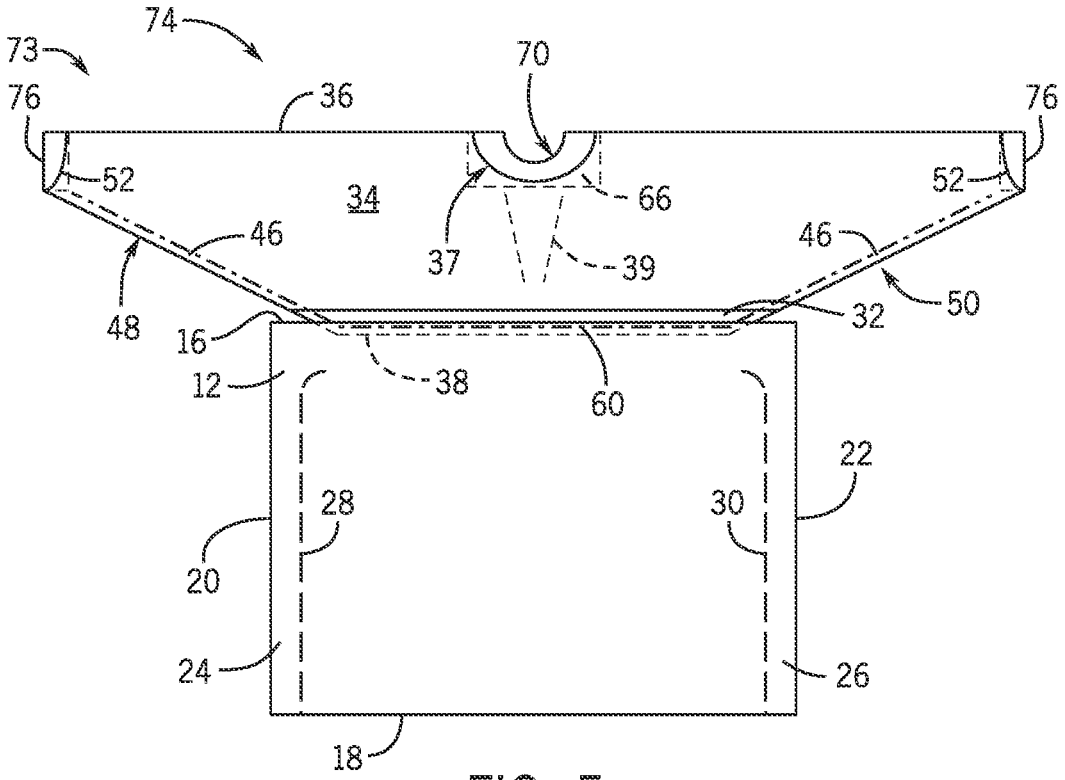
FIG. 5 is a rear view of a multi-piece open-back isolation garment, according to an alternative embodiment of the invention.

Referring now to FIG. 5, an isolation gown 73 is illustrated, according to another embodiment of the invention. Isolation gown 73 includes an alternative shoulder web piece 74 in place of shoulder web piece 14 shown in FIGS. 1A-1D. Isolation gown 73 is illustrated as including torso web piece 12 having the tie strap configuration of FIG. 1A, but it is contemplated that other embodiments may include any of the alternative tie strap configurations illustrated in FIGS. 1B-1D. Since shoulder web piece 74 is arranged similarly to shoulder web pieces 14, 62, 64 of FIGS. 1A-1D, 2, and 3, like elements in shoulder web piece 74 are numbered identically to corresponding elements in shoulder web pieces 14, 62, 64. Like shoulder web pieces 62, 64 of FIGS. 2 and 3, shoulder web piece 74 differs from shoulder web piece 14 of FIGS. 1A-1D in the application of neck stretch patch 66 over neck opening 37.

However, shoulder web piece 74 differs from shoulder web pieces 62, 64 (FIGS. 2 and 3) in that shoulder web piece 74 includes a different configuration of wrist stretch patches 76 applied over corresponding wrist openings 52 in sleeves 48, 50. Wrist stretch patches 76 are folded over top edge 36 across wrist openings 52, with wrist openings 52 provided facing the right and left edges of sleeves 48, 50. During the manufacturing process, wrist stretch patches 76 and wrist openings 52 are positioned to span two adjacent isolation gowns 10, as explained with respect to FIG. 10 below.

Figure 6:
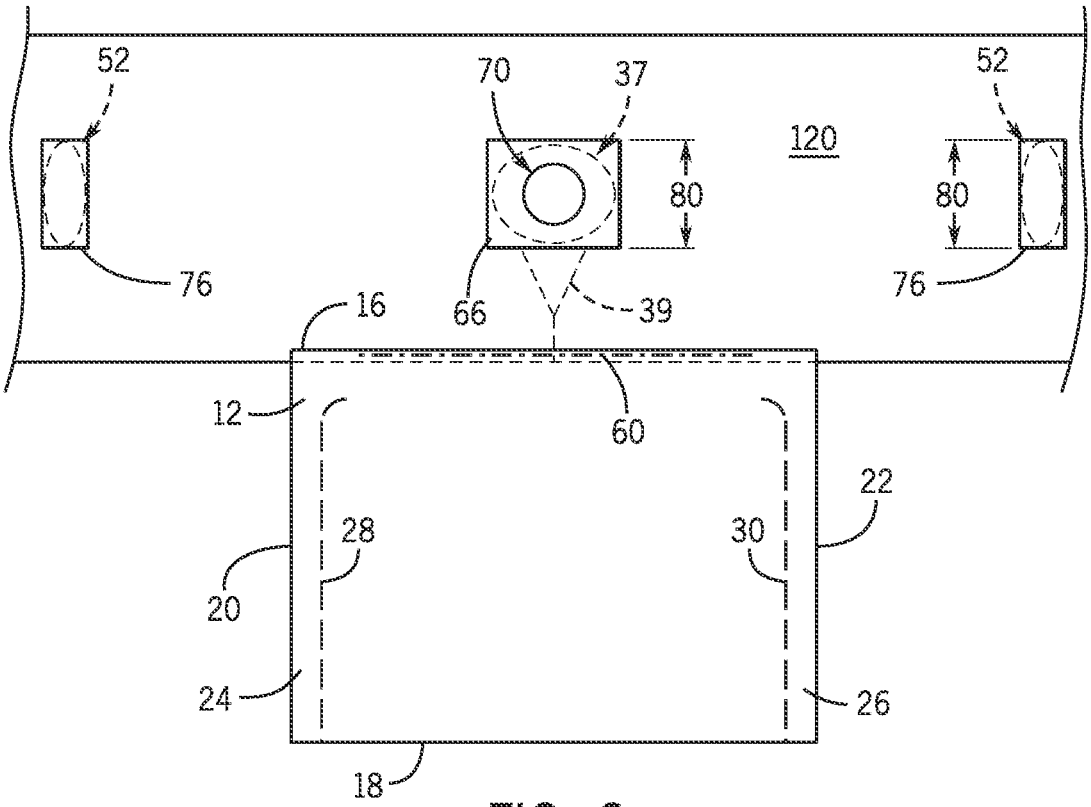
FIG. 6 is a top view of a portion of the production flow for forming the multi-piece open-back isolation garment of FIG. 5 illustrating application of stretch patches, according to an embodiment of the invention.

Referring to FIG. 6, a top view of neck stretch patch 66 and wrist stretch patches 76 of shoulder web piece 74 of FIG. 5 are illustrated in relation to a continuous shoulder web 120 including neck opening 37 and wrist openings 52 of shoulder web piece 74 of FIG. 5 during the manufacturing process for isolation gown 73, according to an embodiment of the invention. Neck stretch patch 66 is arranged in the same manner as shown in FIG. 4, with neck opening 70 smaller than neck opening 37 in front and rear shoulder web panels 32, 34. Like neck and wrist stretch patches 66, wrist stretch patches 76 may be made of a stretchable material such as, for example, an elastic film, elastic adhesive, elastic composite, or elastic laminate. After wearers of isolation gown 10 insert their heads and hands through the stretchable material of neck and wrist stretch patches 66, 76, respectively, neck and wrist stretch patches 66, 76 contract onto their necks and wrists to create seals to provide more protection from the intrusion of possibly hazardous, infection, or unclean materials into isolation gown 10.

In addition, the size of wrist stretch patches 76 provides an advantage during manufacturing. More specifically, as shown in FIG. 6, a length 80 of wrist stretch patches 76 is equal to that of neck stretch patch 70. As such, wrist stretch patches 68 of FIGS. 2-4, wrist stretch patches 76 may be applied to front and rear shoulder web panels 32, 34 with the same machine as that used to apply neck stretch patches 66. This will be discussed in further detail with respect to FIG. 10 below.

Figure 7:
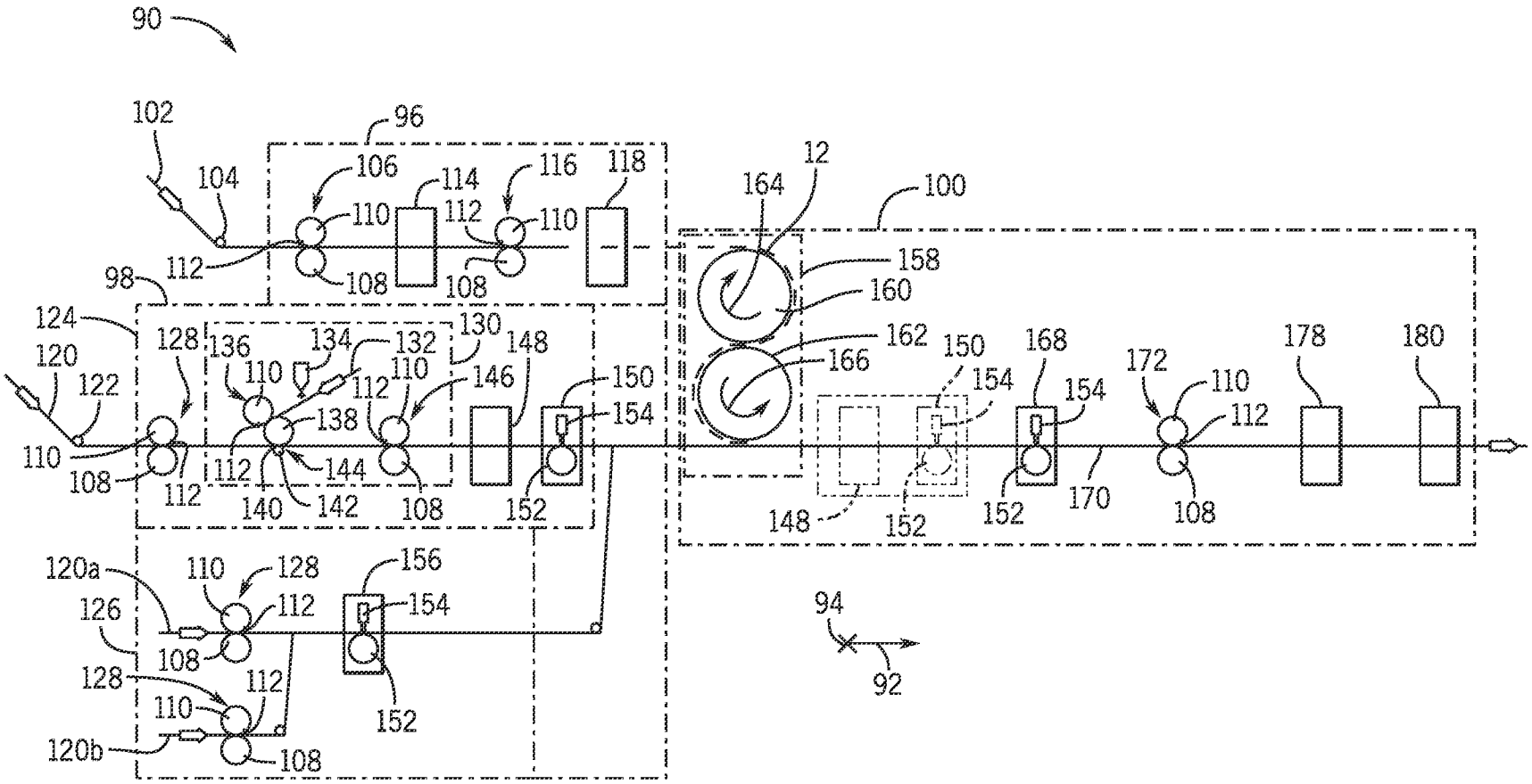
FIGS. 7 and 8 are schematic views of a portion of a manufacturing line and associated production flow for forming multi-piece open-back isolation garments, according an embodiment of the invention.
Figure 8:
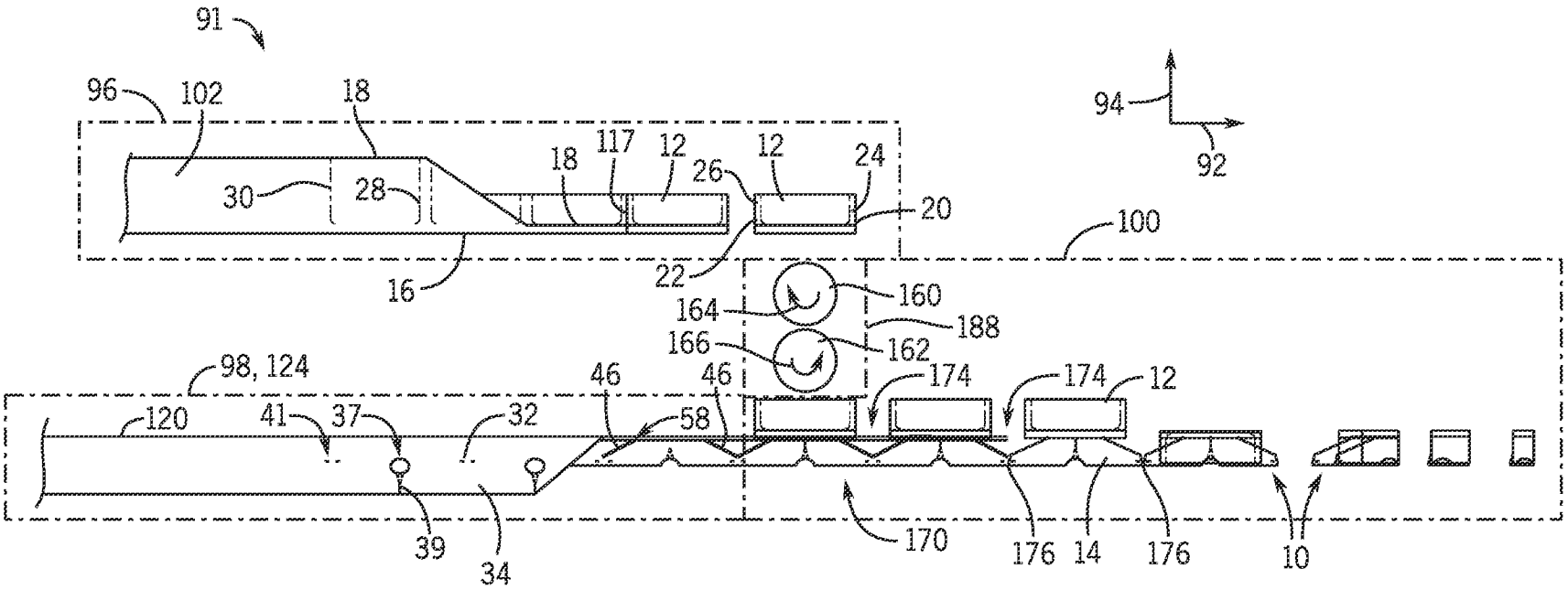
Figure 9:
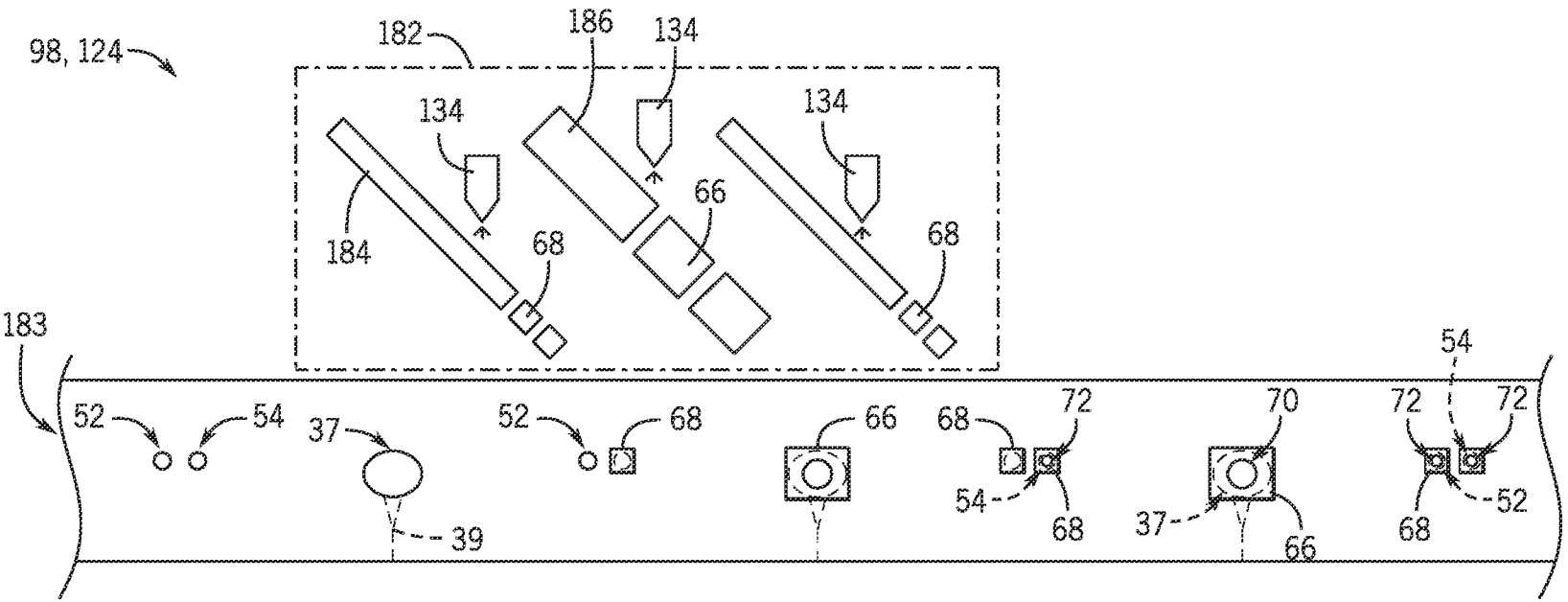
FIGS. 9 and 10 are schematic views of a portion of a manufacturing line and associated production flow for forming shoulder web pieces including stretch patches for multi-piece open-back isolation garments, according to embodiments of the invention.
Figure 10:
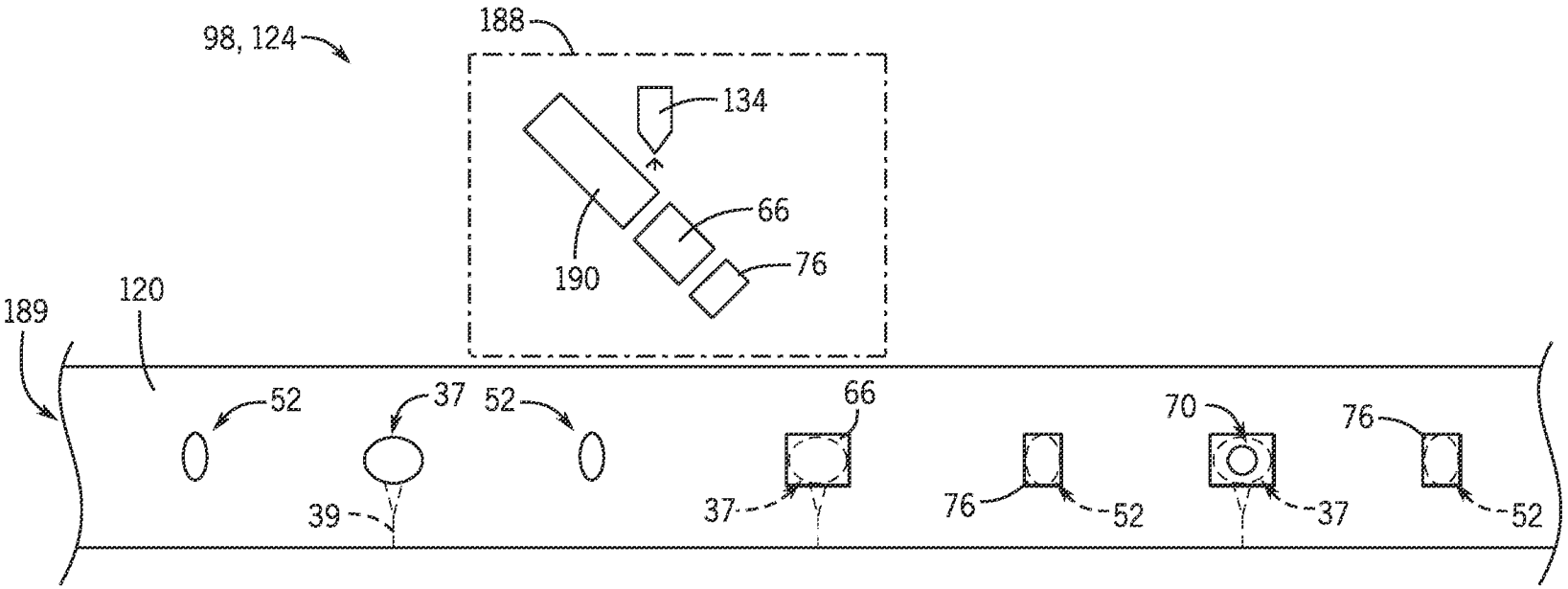

Referring now to FIGS. 7-10, portions of an exemplary manufacturing line 90 for manufacturing multi-piece open-back isolation gowns 10 and associated production flow 91 is illustrated, according to an embodiment of the invention. FIG. 7 illustrates the machinery in manufacturing line 90 for performing a method of manufacturing multi-piece open-back isolation gowns 10. FIG. 8 illustrates how webs may be manipulated and combined into multi-piece open-back isolation gown 10 of FIGS. 1A-1D including shoulder web piece 14 in manufacturing line 90. FIG. 9 illustrates how webs may be manipulated to create shoulder web pieces 62, 64 of FIGS. 2 and 3, respectively, in manufacturing line 90. FIG. 10 illustrates how webs may be manipulated to create shoulder web piece 74 of FIG. 5 in manufacturing line 90. As such, like elements in FIGS. 1A-1D and 2-6 are numbered identically to corresponding elements in FIGS. 7-10.

Referring to FIGS. 7 and 8, manufacturing line 90 includes a torso web piece section 96 that forms torso web pieces 12, a shoulder web piece section 98 that forms one of shoulder web pieces 14, 62, 64, 74, and an isolation gown section 100 that forms multi-piece open-back isolation gowns 10, 61, 63, 73 from torso web piece 12 and one of shoulder web pieces 14, 62, 64, 74. In general, manufacturing line 90 performs operations along a machine direction 92, but also performs operations in a cross-machine direction 94 that is perpendicular to machine direction 92. In order to facilitate the formation of torso web pieces 12, a continuous torso web 102 is fed into torso web piece section 96 in machine direction 92. Continuous torso web 102 may be fed into torso web piece section 96 via a turnbar infeed process during which continuous torso web 102 is unwound from a roll (not shown).

Continuous torso web 102 is then directed past at least one roller 104 to an optional perforation unit or apparatus 106 including a rotary anvil 108 aligned with a rotary knife roll 110 having one or more knives 112. Each knife 112 may be positioned within an insert (not shown) on rotary knife roll 110 and arranged to align with a corresponding insert (not shown) inset within rotary anvil 108 during operation of perforation unit 106. Perforation unit 106 may be included in order to cut perforation lines in continuous torso web 102 in order to define one or more tie straps. As a non-limiting example, perforation unit 106 may be configured to cut perforation lines 28, 30 in continuous torso web 102 in order to define tie straps 24, 26, as shown in FIG. 8. While tie straps 24, 26 are shown in FIG. 8 in the configuration of gown 10 of FIG. 1A, perforation unit 106 may be configured to create tie straps in any of the alternative configurations shown in FIGS. 1B-1D. In yet other embodiments, perforation unit 106 may be a cutting unit that cuts tie straps off of continuous torso web 102 for reattachment to torso web pieces 12 later in manufacturing line 90. Further, tie straps may also be made offline from a web separate from continuous torso web 102 and attached to torso web pieces 12 in manufacturing line 90 or packaged as unattached strips with completed gowns 10, 61, 63, 73.

After passing through perforation unit 106, continuous torso web 102 is folded in cross-machine direction 94 by a folding unit or apparatus 114 to make torso web pieces 12 easier to manipulate once they are separated from continuous torso web 102. Folding unit 114 may include belts, rotary wheels, discs, rollers, fixed rods or plates of various shapes (flat or three-dimensional) and/or other known folding technologies. As shown in FIG. 8, the fold in continuous torso web 102 is slightly off center such that bottom edge 18 on continuous torso web 102 is folded toward, but spaced apart from, top edge 16 on continuous torso web 102. The spacing between top and bottom edges 16, 18 of continuous torso web 102 aids in bonding discrete torso web pieces 12, as will be described in more detail below with respect to isolation gown section 100 of manufacturing line 90.

Once continuous torso web 102 is folded, it is fed to a torso cutting unit or apparatus 116, such as a rotary die, knife roll with rotary anvil, laser technology, ultrasonic technology, or other known cutting means, for cutting discrete torso web pieces 12 from continuous torso web 102. Cutting unit 116 is shown in FIG. 7 with the same components as perforation unit 106 including rotary anvil 108 aligned with rotary knife roll 110 having one or more knives 112. However, in cutting unit 116, each knife 112 on rotary knife roll 110 is configured to completely separate discrete torso web pieces 12 rather than create perforation lines. This is shown most clearly in FIG. 8 by way of cut line 117 separating one discrete torso web piece 12 from continuous torso web 102 after being folded. While FIG. 7 illustrates cutting unit 116 after folding unit 114 in manufacturing line 90, the locations of the folding and cutting units 114, 116 may be switched such that cutting unit 116 cuts discrete torso web pieces 12 from continuous torso web 102 and then folding unit 114 folds discrete torso web pieces 12 rather than continuous torso web 102. Regardless, all resulting folded discrete torso web pieces 12 are re-pitched in a re-pitching unit or apparatus 118 in order to create separation between them for their placement onto a continuous shoulder web 120, as explained in more detail below with respect to isolation gown section 100. Re-pitching unit 118 may include rotary or linear servo/electro-magnetic technology, mechanical cams, speed mis-match between adjacent units, and/or other known re-pitching technologies. While a single re-pitching unit 118 is shown, alternate embodiments may include multiple re-pitching units positioned before and/or after transfer unit 586 to re-pitch the discrete torso web pieces 12 prior to transfer to continuous shoulder web 120.

As shown in FIGS. 7 and 8, shoulder web piece section 98 operates simultaneously with torso web piece section 96. To begin, at least one continuous shoulder web 120 is fed into shoulder web piece section 98 of manufacturing line 90 in machine direction 92. Continuous shoulder web(s) 120 may be fed into shoulder web piece section 98 via a turnbar infeed process during which continuous torso web 120 is unwound from a roll (not shown) and directed past at least one roller 122. Shoulder web piece section 98 will be in one of two different configurations 124, 126 for processing continuous shoulder webs 120. In configuration 124, a single continuous shoulder web 120 is provided, folded, and bonded together. In alternative configuration 126, two separate continuous shoulder webs 120*a*, 120*b* are provided and bonded together.

Initially, regarding configuration 124, continuous shoulder web 120 is directed to a die and/or perforation unit or apparatus 128, such as a rotary die, knife roll with rotary anvil, laser technology, ultrasonic technology, or other known cutting means. In FIG. 7, die and/or perforation unit 128 includes rotary anvil(s) 108 and rotary knife roll(s) 110 with one or more knives 112. Die and/or perforation unit 128 is configured to cut neck openings 37 in continuous shoulder web 120 and may optionally cut perforation lines 39 and thumb openings 41 in continuous shoulder web 120, as shown in FIG. 8. Thus, die and/or perforation unit 128 may be considered a neck cutting unit 128 or a neck and perforation cutting unit 128. In one embodiment, die and/or perforation unit 128 includes a single rotary anvil 108/rotary knife roll 110 pair with knives 112 configured to cut neck openings 37, perforation lines 39, and thumb openings 41. In such an embodiment, die and/or perforation unit 128 may be cammed to create neck openings 37, perforation lines 39, and thumb openings 41 at the desired spacing. In an alternate embodiment, die and/or perforation unit 128 includes two or more separate rotary anvil 108/rotary knife roll 110 pairs, spaced in the machine direction 92, for cutting neck openings 37, perforation lines 39, and thumb openings 41. Any or all of the separate rotary anvil 108/rotary knife roll 110 pairs may be cammed. Thereafter, continuous shoulder web 120 may pass through an optional stretch patch unit 130. Stretch patch unit 130 may be used to apply neck stretch patches 66 of FIGS. 2-6, wrist stretch patches 68 of FIGS. 2-4, and/or wrist stretch patches 76 of FIGS. 5 and 6 when forming shoulder web piece 62 of FIG. 2, shoulder web piece 64 of FIG. 3, or shoulder web piece 74 of FIG. 5.

FIG. 7 illustrates that at least one continuous stretch patch web 132 may be fed into stretch patch unit 130. This may be done via a turnbar infeed process during which each continuous stretch patch web 132 is unwound from a roll (not shown). The number of continuous stretch patch webs 132 supplied to stretch patch unit 130 depends, at least in part, on whether different size stretch patches are necessary to create shoulder web pieces 62, 64, 74. Each continuous stretch web 132 is passed by an adhesive applicator 134 that applies adhesive to continuous stretch web 132. Thereafter, each continuous stretch web 132 is directed to a slip cut unit or apparatus 136 for the creation of stretch patches such as, for example, neck stretch patches 66, wrist stretch patches 68, and/or wrist stretch patches 76.

Slip cut unit 136 includes a rotary vacuum anvil 138 and rotary knife roll 110 including one or more knives 112. Continuous stretch patch web 132 is fed at a relatively low speed along rotary vacuum anvil 138, which is moving at a relatively higher surface speed and upon which continuous stretch patch web 132 is allowed to "slip." Each knife 112, which is preferably moving at a surface velocity similar to that of rotary vacuum anvil 138, cuts off a segment of continuous stretch patch web 132 against rotary vacuum anvil 138 to create discrete stretch patches (not shown in FIG. 7), which, as stated above, may correspond to neck stretch patches 66, wrist stretch patches 68, and/or wrist stretch patches 76. Once cut, each discrete stretch patch is held by a vacuum drawn through holes (not shown in FIG. 7) in rotary vacuum anvil 138 as it is carried at the speed of rotary vacuum anvil 138 downstream to a transfer point 140 where it is transferred onto continuous shoulder web 120 with the adhesive from adhesive applicator 134 contacting continuous shoulder web 120. A roller 142 is positioned across from rotary vacuum anvil 138 such that continuous shoulder web 120 with the discrete stretch patches thereon passes through a nip 144 between rotary vacuum anvil 138 and roller 142 in order to press the stretch patches onto continuous shoulder web 120.

Once the stretch patches have been applied to continuous shoulder web 120, continuous shoulder web 120 passes through one or more die units or apparatuses 146 including rotary anvil 108 and rotary knife roll 110 with one or more knives 112. The configuration of knives 112 on rotary knife roll 110 of die unit(s) 146 is designed to cut neck and/or wrist openings in the stretch patches. As such, die unit(s) 146 may be considered patch opening cutting unit(s) 146. For example, die unit(s) 146 may be configured to cut neck openings 70 in neck stretch patch 66 of FIGS. 2-6 and/or wrist openings 72 in wrist stretch patches 68 of FIGS. 2-4. Non-limiting examples of how stretch patches 66, 68, and 76 may be applied to continuous shoulder web 120 by slip cut unit 136 and cut by die unit(s) 146 in stretch patch unit 130 will be described below with respect to FIGS. 9 and 10.

After passing through stretch patch unit 130 or, if stretch patch unit 130 is not included, after passing through die and/or perforation unit 128, continuous shoulder web 120 is folded in cross-machine direction 94 by a folding unit or apparatus 148. Folding unit 148 may include belts, rotary wheels, discs, rollers, fixed rods or plates of various shapes (flat or three-dimensional) and/or other known folding technologies. As shown most clearly in FIG. 8, the fold in continuous shoulder web 120 is performed to define front and rear shoulder web panels 32, 34 of in FIGS. 1A-D, 2-3, and 5 with folded top edge 36. As such, the fold created by folding unit 148 is slightly off-center in order to create area 58 of front shoulder web panel 32 that is uncovered by rear shoulder web panel 34.

Once folded, continuous shoulder web 120 passes through bonding unit or apparatus 150. In FIG. 7, bonding unit 150 is shown as an ultrasonic bonding unit 150 including a rotary anvil 152 and an ultrasonic fixed blade horn or sonotrode 154 that cooperate to create underarm seams in continuous shoulder web 120. As shown in FIG. 8, the underarm seams may be, for example, underarm seams 46 shown in shoulder web pieces 14, 62, 64, 74 of FIGS. 1A-D, 2-3, and 5. However, bonding unit 150 may alternatively include components for creating the underarm seams via a different bonding technique such as, for example, thermal, pressure, or adhesive bonding techniques or various other forms of bonding known in the industry. Regardless of which type of bonding technique is utilized by bonding unit 150, both folding unit 148 and bonding unit 150 may be positioned downstream in manufacturing line 90 such as, for example, in isolation gown section 100.

If configuration 126 of shoulder web piece section 98 is used in manufacturing line 90 instead of configuration 124, shoulder web piece section 98 will receive two continuous shoulder webs 120*a*, 120*b*. In the same manner as in configuration 124, each continuous shoulder web 120*a*, 120*b* will pass through separate die and/or perforation units 128 to create neck openings 37 and/or optional perforations 39 and thumb openings 41. Thereafter, the two continuous shoulder webs 120*a*, 120*b* are laid on top of each other and passed through a bonding unit or apparatus 156. Like bonding unit 150, bonding unit 156 is shown in FIG. 7 as including rotary anvil 152 and sonotrode 154 for performing ultrasonic bonding, but may include equipment for performing another bonding technique such as, for example, thermal, pressure, or adhesive bonding. However, in addition to creating underarm seams in continuous shoulder webs 120*a*, 120*b*, bonding unit 156 also creates a top seam (not shown) adjacent to top edges (not shown) of continuous shoulder webs 120*a*, 120*b*. The result of the bonding is that the combined front and rear continuous shoulder webs 120*a*, 120*b* are arranged similarly to continuous shoulder web 120 of configuration 124, but with the inclusion of the seam between front and rear continuous shoulder web panels 120*a*, 120*b*. As such, the combined front and rear continuous shoulder webs 120*a*, 120*b* will be referred to as continuous shoulder web 120.

As illustrated by FIGS. 7 and 8, after torso web piece section 96 and shoulder web piece section 98 have completed their operations, torso web pieces 12 and continuous shoulder web 120 are provided by torso and shoulder web piece sections 96, 98, respectively, to isolation gown section 100. Isolation gown section 100 includes a torso web piece transfer unit or apparatus 158 including two vacuum transfer drums or rolls 160, 162. In each of vacuum transfer drums 160, 162, a vacuum drawn through holes (not shown) to carry torso web pieces 12 and transfer them to continuous shoulder web 120. More specifically, vacuum transfer drum 160 receives torso web pieces 12 from torso web piece section 96 and carries them in a clockwise direction 164 until they reach vacuum transfer drum 162, at which point, vacuum transfer drum 160 releases torso webs 12 and vacuum transfer drum 162 carries them in a counter-clockwise direction 166 to continuous shoulder web 120. Torso web pieces 12 are positioned on continuous shoulder web 120 such that top edge 16, and not bottom edge 18, of each torso web piece overlaps bottom edge 40 of front shoulder panel 32 in area 58 of front shoulder panel 32 uncovered by rear shoulder panel 34. While torso web piece transfer unit 158 is shown in FIG. 7 as transferring torso web pieces 12 to continuous shoulder web 120 either after or before continuous shoulder web 120 passes through folding and bonding units 148, 150, torso web piece transfer unit 158 may transfer torso web pieces 12 at various points upstream in configurations 124, 126 of shoulder web piece section 98.

In an alternative embodiment, transfer unit 158 may be in the form of a unit that takes the place of vacuum rolls 160, 162. The unit may be in the form of a cam-based system (not shown) in which a plurality of vacuum pucks (not shown) may re-pitch and/or rotate discrete torso web pieces 12 and place them onto continuous shoulder web 120. The unit may also be a track-based system (not shown) in which a plurality of vacuum pucks (not shown) on a track re-pitch and/or rotate discrete torso web pieces 12 and place them onto continuous shoulder web 120. In the track-based system, the vacuum pucks may be controlled individually by separate drive elements on the track and could then be more easily reconfigured electronically as necessary. In the case where transfer unit 158 is the cam-based or track-based system, discrete torso web pieces 12 may optionally be folded by a folding unit (not shown) before being carried by transfer unit 158. In embodiments where transfer unit 158 incorporates re-pitching functionality, re-pitching unit 118 may be omitted. Alternate embodiments may include multiple re-pitching units positioned before and/or after transfer unit 158 to re-pitch the discrete torso web pieces 12 prior to transfer to continuous shoulder web 120.

As explained above, once torso web pieces 12 are placed onto continuous shoulder web 120, continuous shoulder web 120 may then be passed through folding and bonding units 148, 150 if it has not already passed through folding and bonding units 148, 150 in configuration 124 of shoulder web piece section 98. Next, torso web pieces 12 and continuous shoulder web 120 are bonded together in a bonding unit 168. In the illustrated embodiment, bonding unit 168 includes a rotary anvil 152 and sonotrode 154 for ultrasonic bonding. However, as similarly explained above with respect bonding units 150, 156, bonding unit 168 may include components for performing another type of bonding like thermal or pressure bonding, as non-limiting examples. In yet other embodiments, bonding unit 168 is an adhesive applicator that places a strip of adhesive (not shown) on continuous shoulder web 120 or on each torso web piece 12 before each torso web piece 12 is positioned on continuous shoulder web 120 to bond discrete torso web pieces 12 to continuous shoulder web 120. As shown in FIG. 8, regardless of the technique used to bond torso web pieces 12 and continuous shoulder web 120, bonding unit 168 bonds torso web pieces 12 to continuous shoulder web 120 to create seam 60 between torso web piece 12 and front shoulder web panel 32 in area 58 of front shoulder web panel 32 uncovered by rear shoulder web panel 34. In embodiments that bond with adhesive, isolation gown section 100 may include nip rollers (not shown) that press torso web pieces 12 and continuous shoulder web 120 together at the adhesive strip.

After torso web pieces 12 and continuous shoulder web 120 are bonded together, the combined structure may be considered as a continuous isolation garment web—referred to hereafter as isolation gown web 170. Continuous isolation gown web 170 is directed to a die unit or apparatus 172 including rotary anvil 108 and rotary knife roll 110 with one or more knives 112 configured to cut out the excess underarm material 174 from continuous shoulder web material 120 below underarm seams 46 in front and rear shoulder panels 32, 34 and create underarm edges 40, 44 in front and rear shoulder panels 32, 34, respectively. Die unit 172 may also be configured to separate continuous isolation gown web 170 into discrete multi-piece open-back isolation gowns 10, 61, 63, 73 including torso web piece 12 and shoulder web piece 14, 62, 64, 74, respectively, at cut lines 176. FIG. 8 illustrates isolation gowns 10 with torso web piece 12 and shoulder web pieces 14, as similarly shown in FIG. 1. Alternatively, die unit 172 may create cut lines 176 as perforation lines 176 when it is desired to package continuous isolation gown web 170 in a roll from which an individual may tear discrete isolation gowns 10 as needed.

Once die unit 172 has removed excess underarm material 174 and/or cut continuous isolation gown web 170 into discrete isolation gowns 10, 61, 63, 73, continuous isolation gown web 170 or discrete isolation gowns 10, 61, 63, 73 are folded in cross direction 94 by a folding unit or apparatus 178, which may include belts, rotary wheels, discs, rollers, fixed rods or plates of various shapes (flat or three-dimensional) and/or other known folding technologies. While FIG. 8 illustrates that folding unit 178 folds torso web pieces 12 over shoulder web pieces 14, folding unit 178 may instead fold shoulder web pieces 14 over torso web pieces 12. In an alternative embodiment, folding unit 178 is positioned upstream of die unit 172. After passing through die unit 172 and folding unit 178, discrete isolation gowns 10, 61, 63, 73 pass through a multi-stage folding unit or apparatus 180. As non-limiting examples, multi-stage folding unit 180 may include multiple folding stations such as, for example, three tuckers (not shown) or multiple pairs of rotating folding blades (not shown) that perform a tri-fold operation on each isolation gown 10 to make them ready for packaging, as shown in FIG. 8. While a tri-fold configuration is described herein, it is contemplated that multi-stage folding unit 180 may be configured to create any number of folds in each isolation gown 10, 61, 63, 73 to create the desired package shape. However, if continuous isolation gown web 170 has not been separated into discrete isolation gowns 10, 61, 63, 73, continuous isolation gown web 170 may be fed into a rewinder (not shown) and rolled up or rewound for packaging in an isolation gown web dispenser (not shown) from which discrete isolation gowns 10 may be torn, as described above.

Referring now to FIG. 9, a simplified view of a stretch patch unit or apparatus 182 along with a corresponding processing flow 183 is illustrated, according to an embodiment of the invention. Stretch patch unit 182 may be used as stretch patch unit 130 in FIG. 7 to place neck stretch patches 66 and wrist stretch patches 68 on continuous shoulder web 120 for creating shoulder web pieces 62, 64 shown in FIGS. 2 and 3. While not depicted in the simplified view shown in FIG. 9, it will be understood that stretch patch unit 182 includes adhesive applicators 134, slip cut units 136, and die units 146 shown in stretch patch unit 130 of FIG. 7 as necessary to perform stretch patch operations.

Referring now to FIGS. 7 and 9 together as appropriate, two continuous wrist stretch patch webs 184 and one continuous neck stretch patch web 186 are fed into stretch patch unit 182, and adhesive applicators 134 apply adhesive to webs 184, 186. After adhesive is applied, separate slip cut units 136 cut discrete wrist stretch patches 68 and discrete neck stretch patches 66 from continuous wrist and neck stretch patch webs 184, 186, respectively, and place them over wrist openings 52, 54 and neck opening 37, respectively. Next, one or more die units 146 cut wrist openings 72 and neck openings 70 in wrist stretch patches 68 and neck stretch patches 66, respectively. Thereafter, continuous shoulder web 120 will continue on to folding and bonding units 148, 150 of configuration 124 of shoulder web piece section 98 shown in FIG. 7. Folding and bonding units 148, 150 will perform the folding and bonding operations described above with respect to FIGS. 7 and 8 to form shoulder web pieces 62, 64 shown in FIGS. 2 and 3.

Referring now to FIG. 10, a simplified view of a stretch patch unit or apparatus 188 along with a corresponding process flow 189 is illustrated, according to another embodiment of the invention. Like stretch patch unit 182, stretch patch unit 188 may be used as stretch patch unit 130 in FIG. 7. However, stretch patch unit 188 is used to place neck stretch patches 66 and wrist stretch patches 76 on continuous shoulder web 120 for creating shoulder web piece 74 shown in FIG. 5. While not depicted in the simplified view shown in FIG. 10, it will be understood that stretch patch unit 188 includes adhesive applicators 134, slip cut units 136, and die units 146 shown in stretch patch unit 130 of FIG. 7 as necessary to perform stretch patch operations.

Referring now to FIGS. 7 and 10 together as appropriate, stretch patch unit 188 utilizes a single continuous stretch patch web 190 due to the fact that neck stretch patches 66 and wrist stretch patches 76 have the same length 80, as shown in FIG. 6. Continuous stretch patch web 188 passes under adhesive applicator 134, which applies adhesive thereto. Then, slip cut unit 136 cuts discrete neck stretch patches 66 and discrete wrist stretch patches 76 from continuous stretch patch web 190. Each discrete neck stretch patch 66 is placed over one neck opening 37 and every discrete wrist stretch patch 76 is placed over one wrist opening 52. Thereafter, one or more die units 146 cut neck opening 70 in neck stretch patches 66 inside of neck opening 37. A given wrist stretch patch 76 is divided in half downstream in isolation gown section 100 by die unit 172 and thus forms the right and left wrist portions of two adjacent gowns 73. Having passed through die unit(s) 146, continuous shoulder web 120 will continue on to folding and bonding units 148, 150 of configuration 124 of shoulder web piece section 98 shown in FIG. 7. Folding and bonding units 148, 150 will perform the folding and bonding operations described above with respect to FIGS. 7 and 8 to form shoulder web pieces 74 shown in FIG. 5.

Beneficially, embodiments of the invention include an apparatus and method of manufacturing multi-piece open-back isolation garments having a torso web piece and a shoulder web piece. In manufacturing the shoulder web pieces, front and rear shoulder panels are formed by either folding one continuous shoulder web and bonding the overlapping shoulder web layers or by bonding two continuous shoulder webs together. At the same time, discrete torso web pieces are cut from a continuous torso web by a cutting unit. A transfer unit transfers the discrete torso web pieces onto the continuous shoulder web such that top edges of the discrete torso web pieces overlap a bottom edge of the front shoulder web panels of the continuous shoulder web in an area that is uncovered by the rear shoulder web. Thereafter, the discrete torso web pieces are bonded to the front shoulder web panel of the continuous shoulder web in the area uncovered by the rear shoulder web to form a continuous multi-piece open-back isolation garment web which may be rewound into a roll or cut to form discrete isolation garments for folding and packaging. The manufacturing of the multi-piece open-back isolation garments can quickly produce the isolation garments without manual input and with only a small amount of scrap material. The formation of the torso web pieces does not result in any scrap material, and the formation of the shoulder web pieces results in only minimal scrap material from cutting neck and wrist openings and excess underarm material.

Therefore, according to one embodiment of the invention, an apparatus for manufacturing multi-piece open-back isolation garments includes a neck cutting unit configured to cut neck openings in a continuous shoulder web and a first bonding unit configured to create underarm seams between first shoulder web panels and second shoulder web panels overlapping each other in the continuous shoulder web. The apparatus also includes a torso cutting unit configured to cut discrete torso web pieces from a continuous torso web and a transfer unit configured to transfer the discrete torso web pieces onto the first shoulder web panels of the continuous shoulder web such that a top edge of each discrete torso web piece overlaps a bottom edge of the first shoulder web panels in an area of the first shoulder web panels that is uncovered by the second shoulder web panels. In addition, the apparatus includes a second bonding unit configured to bond the discrete torso web pieces to the first shoulder web panels in the area uncovered by the second shoulder web panels to create a continuous isolation garment web.

According to another embodiment of the present invention, a method of manufacturing multi-piece open-back isolation garments includes cutting neck openings in a continuous shoulder web traveling in a machine direction and forming first shoulder web panels and second shoulder web panels overlapping each other in a continuous shoulder web, the first and second shoulder web panels having respective bottom edges offset from each other to create an area on the first shoulder web panel that is uncovered by the second shoulder web panel. The method additionally includes creating underarm seams between the first and second shoulder web panels and cutting a continuous torso web into discrete torso web pieces. Furthermore, the method includes transferring the discrete torso web pieces onto the first shoulder web panels such that a top edge of each discrete torso web piece overlaps the bottom edge of the first shoulder web panels in the area of the first shoulder web panel that is uncovered by the second shoulder web panels and bonding the discrete torso web pieces to the first shoulder web panels in the area that is uncovered by the second shoulder web panels to create a continuous isolation garment web.

According to yet another embodiment of the present invention, a multi-piece garment includes a shoulder web piece having a first shoulder web panel and second shoulder web panel overlapping the second shoulder web panel. The first shoulder web panel includes a bottom edge and a pair of underarm edges extending out from the bottom edge, and the second shoulder web panel includes a bottom edge offset from the bottom edge of the first shoulder web panel to create an area on first shoulder web panel that is uncovered by the second shoulder web panel and a pair of underarm edges extending out from the bottom edge of the second shoulder web panel and substantially aligned with the pair of underarm edges of the first shoulder web panel. The shoulder web piece further includes a pair of underarm seams joining the first and second shoulder web panels at adjacent underarm edges of the first and second shoulder web panels to form first and second sleeves in the shoulder web piece and a neck opening formed in the first and second shoulder web panels across from the bottom edges of the first and second shoulder web panels. The multi-piece garment also includes a torso web piece comprising a top edge overlapping the bottom edge of the first shoulder web panel of the shoulder web piece in the area uncovered by the second shoulder web panel of the shoulder web piece, the torso web piece attached to the first shoulder web panel via a seam positioned between the top edge of the torso web piece and the bottom edge of the first shoulder web panel.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description but is only limited by the scope of the appended claims.

What is claimed is:

1. An apparatus for manufacturing multi-piece open-back isolation garments, the apparatus comprising:

a neck cutting unit configured to cut neck openings in a continuous shoulder web;

a first bonding unit configured to create underarm seams between first shoulder web panels and second shoulder web panels overlapping each other in the continuous shoulder web, the underarm seams extending at substantially the same angle from a bottom edge of each of the first and second shoulder web panels to a position offset from a top edge of each of the first and second shoulder web panels, the underarm seams defining first and second wrist openings on opposing sides the continuous shoulder web;

a torso cutting unit configured to cut discrete torso web pieces from a continuous torso web;

a transfer unit configured to transfer the discrete torso web pieces onto the first shoulder web panels of the continuous shoulder web such that a top edge of each discrete torso web piece overlaps the bottom edge of the first shoulder web panels in an area of the first shoulder web panels that is uncovered by the second shoulder web panels; and a second bonding unit configured to bond the discrete torso web pieces to the first shoulder web panels in the area uncovered by the second shoulder web panels to create a continuous isolation garment web.

2. The apparatus of claim 1 further comprising a perforation unit configured to create at least one perforation line in the torso web piece that defines at least one tie strap.

3. The apparatus of claim 1 further comprising a folding unit positioned upstream from the torso cutting unit and configured to fold the continuous torso web in a cross-machine direction.

4. The apparatus of claim 1 further comprising a stretch patch unit comprising:

at least one adhesive applicator configured to apply an adhesive to at least one continuous stretch patch web;

at least one slip cut unit comprising a vacuum anvil and a knife roll, the at least one slip cut unit configured to:

receive the continuous stretch patch web with adhesive applied on the vacuum anvil;

cut the continuous stretch patch web into discrete stretch patches on vacuum anvil with the knife roll; and apply the discrete stretch patches over the neck openings on the continuous shoulder web with the vacuum anvil; and at least one patch opening cutting unit configured to cut openings in the discrete stretch patches within the neck openings on the continuous shoulder web.

5. The apparatus of claim 1 including a folding unit configured to fold the continuous shoulder web to create the overlapping first shoulder panels and second shoulder panels.

6. The apparatus of claim 1 further comprising another cutting unit configured to cut discrete multi-piece open-back isolation garments from the continuous isolation garment web.

7. The apparatus of claim 6 further comprising a multi-stage folding unit comprising at least three folding stations configured to at least tri-fold each discrete multi-piece open-back isolation garment.

8. The apparatus of claim 1 wherein the transfer unit comprises first and second vacuum drums rotating in opposite directions.

9. A method of manufacturing multi-piece open-back isolation garments, the method comprising:

cutting neck openings in a continuous shoulder web traveling in a machine direction;

forming a first shoulder web panel and a second shoulder web panel overlapping each other in the continuous shoulder web, the first shoulder web panel having a bottom edge offset from a bottom edge of the second shoulder web panel to create an area on the first shoulder web panel that is uncovered by the second shoulder web panel;

creating right and left underarm seams between the first and second shoulder web panels, the right and left underarm seams extending at substantially the same angle from the bottom edge of each of the first and second shoulder web panels to a position offset below a corresponding top edge of each of the first and second shoulder web panels, the underarm seams defining left and right wrist openings between the top edge of each of the first and second shoulder web panels and the corresponding underarm seam on opposing right and left sides the continuous shoulder web;

cutting a continuous torso web into a discrete torso web piece;

transferring the discrete torso web piece onto the first shoulder web panel such that a top edge of the discrete torso web piece overlaps the bottom edge of the first shoulder web panel in the area of the first shoulder web panel that is uncovered by the second shoulder web panel; and bonding the discrete torso web piece to the first shoulder web panel in the area that is uncovered by the second shoulder web panel to create a continuous isolation garment web.

10. The method of claim 9 further comprising cutting the continuous shoulder web into discrete shoulder web pieces to form multi-piece open-back isolation garments.

11. The method of claim 10 folding the multi-piece open-back isolation garments in multiple stages.

12. The method of claim 9 further comprising rewinding the continuous isolation garment web.

13. The method of claim 9 wherein forming the first and second shoulder web panels comprises folding the continuous shoulder web.

14. The method of claim 9 wherein forming the first and second shoulder web panels comprises bonding a first continuous shoulder web to a second continuous shoulder web.

15. The method of claim 9 further comprising:

applying a neck stretch patch over each neck opening in the continuous shoulder web; and cutting an opening in each neck stretch patch.

16. The method of claim 15 further comprising:

cutting wrist openings in the continuous shoulder web;

applying a wrist stretch patch over each wrist opening in the continuous shoulder web; and cutting an opening in each wrist stretch patch.

17. A multi-piece garment comprising:

a shoulder web piece comprising:

a first shoulder web panel comprising:

a bottom edge; and a pair of underarm edges extending out from the bottom edge; and a second shoulder web panel overlapping the first shoulder web panel and comprising:

a bottom edge offset from the bottom edge of the first shoulder web panel to create an area on first shoulder web panel that is uncovered by the second shoulder web panel;

a pair of underarm edges extending out from the bottom edge of the second shoulder web panel and substantially aligned with the pair of underarm edges of the first shoulder web panel; and a pair of underarm seams joining the first and second shoulder web panels at adjacent underarm edges of the first and second shoulder web panels to form first and second sleeves in the shoulder web piece, the underarm seams extending at substantially the same angle from the bottom edges of each of the first and second shoulder web panels to a position offset from a top edge of each of the first and second shoulder web panels, the underarm seams defining first and second wrist openings on opposing sides the first and second shoulder web panels; and a neck opening formed in the first and second shoulder web panels across from the bottom edges of the first and second shoulder web panels; and a torso web piece comprising a top edge overlapping the bottom edge of the first shoulder web panel of the shoulder web piece in the area uncovered by the second shoulder web panel of the shoulder web piece, the torso web piece attached to the first shoulder web panel via a seam positioned between the top edge of the torso web piece and the bottom edge of the first shoulder web panel.

18. The garment of claim 17 wherein the first and second shoulder web panels are integral with each other and share a folded top edge in which the neck opening is located.

19. The garment of claim 18 further comprising a thumb opening formed in each of the first and second sleeves adjacent the folded top edge.

20. The garment of claim 17 wherein the first and second shoulder web panels are attached together via at least one seam formed adjacent the top edges of the first and second shoulder web panels.

21. The garment of claim 17 wherein the torso web piece further comprises at least one perforation line defining at least one tie strap that is at least partially separable from the torso web piece.

* * * * *